US005955958A

United States Patent [19]

Lu

[11] Patent Number: 5,955,958

[45] Date of Patent: Sep. 21, 1999

[54] HOLIDAY CANDY JAR WITH LIGHT AND SOUND EFFECTS

[76] Inventor: Kai Lu, 9003 N. LaCrosse Ave., #1A, Skokie, Ill. 60077

[21] Appl. No.: 09/166,717

[22] Filed: Oct. 5, 1998

[51] Int. Cl.[6] ..... G08B 3/00

[52] U.S. Cl. ..... 340/691.5; 340/691.1; 340/691.2; 340/691.3; 340/691.4; 340/573.1; 362/101; 362/154

[58] Field of Search ..... 340/691.5, 691.1, 340/691.2, 691.3, 691.4, 573.1; 362/101, 154

[56] References Cited

U.S. PATENT DOCUMENTS

D. 313,150 12/1990 Hestehave et al. ..... D7/612

3,878,386 4/1975 Douglas ..... 240/6.4 G 5,662,406 9/1997 Mattice et al. ..... 362/101

*Primary Examiner*—Jeffery A. Hofsass

*Assistant Examiner*—Tai T. Nguyen

[57] ABSTRACT

A holiday candy jar with light and sound effects having a signal sensor (10) which gets continuous signal from a signal source (12). When someone puts his/her hand into the jar trying to get a candy, the signal between the signal source and the signal sensor will be blocked. A control circuit board (20) is connected to the signal sensor (10) through wires (16). When signal is blocked, the control circuit board controls color lights (14) blinking and a speaker (20) producing a special sound for holidays.

18 Claims, 1 Drawing Sheet

HOLIDAY CANDY JAR WITH LIGHT AND SOUND EFFECTS

BACKGROUND—FIELD OF INVENTION

This invention relates to candy jars, specifically to candy jars for holidays such as Halloween.

BACKGROUND—DISCUSSION OF THE PRIOR ART

Candy jars can be found in supermarkets and department stores. Such candy jars are used just for storing candies. During holidays, they can not be used as holiday decoration items and they do not give any entertainment.

There are seven U.S. patents related to candy jar: U.S. Pat. No. 313,150, Candy jar, issued Dec. 25, 1990; U.S. Pat. No. 252,005, Candy jar, issued Jun. 5, 1979. U.S. Pat. No. 296,967, Covered candy dish, issued Aug. 2, 1988; U.S. patent D. 283,449, Lamp base, issued Apr. 15, 1986; U.S. Pat. No. 270,508, Covered pedestal jar or similar article, issued Sep. 13, 1983; U.S. Pat. No. 266,135, Covered bowl or similar article, issued Sep. 14, 1982; U.S. Pat. No. 3,998,922, Method of making a candle in container, issued Dec. 21, 1976. None of the patents above is intended to be a holiday decoration item and none of them has light or sound effects.

There are six U.S. patents related to Halloween container: U.S. Pat. No. 5,628,164, Floral container having a water-impermeable external layer, issued May 13, 1997; U.S. Pat. No. 5,605,012, Floral container having a water-impermeable external layer, issued Feb. 25, 1997; U.S. Pat. No. 5,572,826, Collapsible vase for containing a floral grouping, issued Nov. 12, 1996, U.S. Pat. No. 5,515,644, Floral container having a water-impermeable external layer, issued May 14, 1996; U.S. Pat. No. 5,449,179, Holiday bingo having stickers and candy markers, issued Sep. 12, 1995; U.S. Pat. No. 5,402,599, Floral container having a water-impermeable external layer, issued Apr. 4, 1995. My invention is different from these six patents because I do not emphasize on shape, size or material used. I combine the candy jar with photoelectronic technology, making the candy jar exciting and interesting during holidays especially Halloween.

OBJECTS AND ADVANTAGES

Accordingly, the major advantage of this Holiday Candy Jar is its multiple usages. It can be used as a normal candy jar, a Halloween decoration item, a Halloween toy or a Halloween entertainment item.

DRAWING FIGURES

REFERENCE NUMBERS IN DRAWINGS

| | |
|---|---|
| 10 light sensor | 12 light source |
| 14 color light | 16 wire |
| 18 inner base | 20 optoelectronics circuit board, battery and speaker |
| 22 outer base | |

SUMMARY

In accordance with the present invention a holiday candy jar comprises a colorful jar, a light source, a light sensor, an optoelectronics circuit board, a battery, a speaker and color lights.

Figure 1:
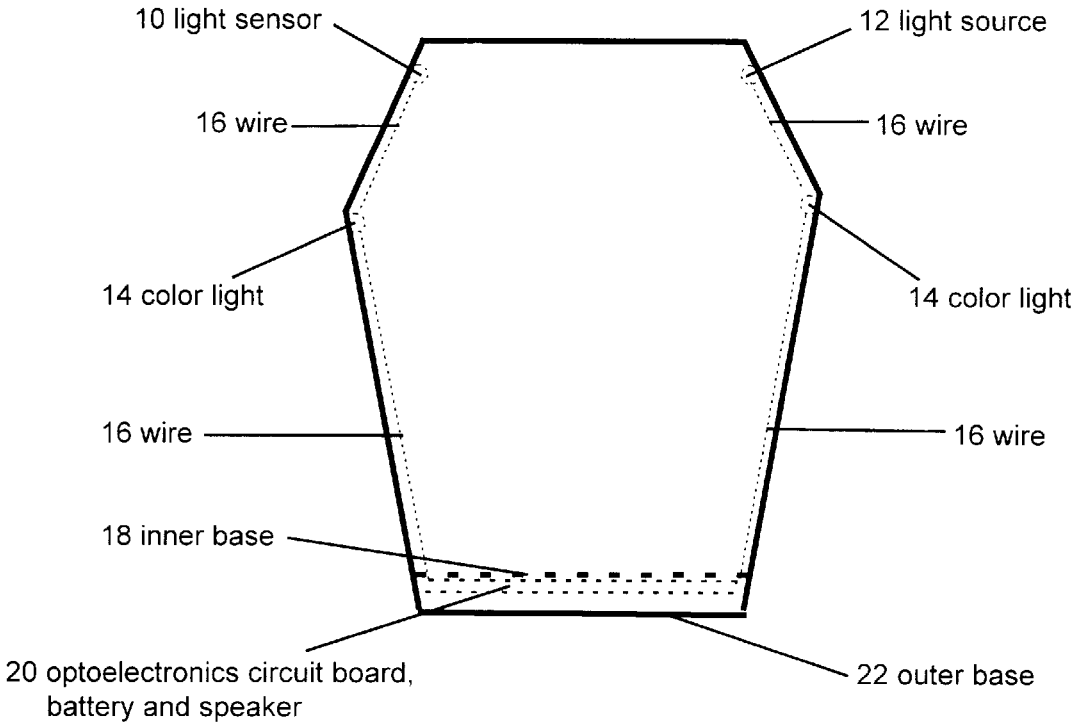
FIG. 1 shows the front view of a holiday candy jar.
Figure 2:
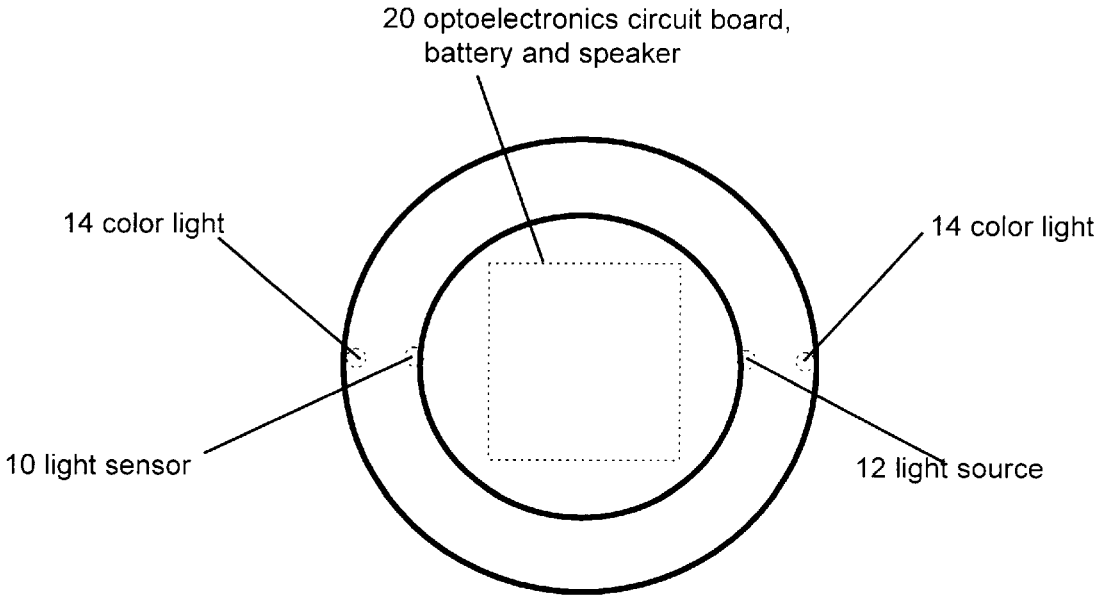
FIG. 2 shows the top view of a holiday candy jar.

Description—FIGS. 1 and 2

FIG. 1 shows the front view of a basic version of my widget. It is a colorful jar with two bases: an outer base (FIG. 1, 22) and an inner base (FIG. 1, 18). The space between these two bases should be big enough to hold an optoelectronics circuit board, and a battery (FIG. 1, 20). Mount the optoelectronics circuit board, speaker and battery on the inner base, between the inner and outer bases of the jar. Mount a light source (FIG. 1, 12) and a light sensor (FIG. 1, 10) on the inside wall of the jar, and they should be right below the opening of the jar. The light source and light sensor must be on the same horizontal level and on a diameter of the jar, so that the light sensor can receive light from the light source (see FIG. 1 and FIG. 2). Mount color lights (FIG. 1, 14) on the inside wall of the jar, and they should be below the light source and light sensor. The color lights should be evenly distributed along the circle of the jar (see FIG. 2). Light source, light sensor and color lights are connected to the optoelectronics circuit board through wires (FIG. 1, 16).

Operation—FIGS. 1 and 2

Put appropriate amount of candy or holiday items into the jar. When a person puts his/her hand into the jar trying to get a candy, the light between the light source and the light sensor is blocked, then the light sensor will send a signal to the optoelectronics circuit board, so that the color lights will blink and the speaker will make a special sound, for example, an animal sound, a person's scream or some kind of music.

Conclusion, Ramifications, and Scope of Invention

Thus the reader will see that the candy jay of the invention provides multiple usage during holidays, specially Halloween. It looks like a regular jar. When someone tries to get a candy from it, it will make a special sound and produce lightening. So it provides holiday entertainment.

While my description above contains specificities, these should not be construed as limitations on the scope of the invention but rather as an exemplification of one preferred embodiment thereof. Many other variations are possible. For example, a candy jar looks like a pumpkin on the table during Halloween, when a person try to get a candy from it, the pumpkin candy jar makes lightening and screaming. Therefore the person will be excited and as a result Halloween entertainment is achieved.

Accordingly, the scope the invention should be determined not by embodiment illustrated, but by the appended claims and their legal equivalents.

I claim:

1. A holiday candy jar with light and sound effects comprising a colorful jar, a signal source, a signal sensor, a sound producer, a control circuit board, a plurality of color lights, a power supply, a means for mounting said signal source and said signal sensor inside said colorful jar so that said signal sensor can receive signal from said signal source, a means for mounting said control circuit board, said sound producer, said color lights and said power supply inside said colorful jar.

2. The holiday candy jar of claim 1 wherein said colorful jar is made of plastic.

3. The holiday candy jar of claim 1 wherein said colorful jar is made of glass.

4. The holiday candy jar of claim 1 wherein said colorful jar is made of earthenware.

5. The holiday candy jar of claim 1 wherein said colorful jar looks like a pumpkin.

6. The holiday candy jar of claim 1 wherein said colorful jar looks like an egg.

7. The holiday candy jar of claim 1 wherein said signal source is a light source and said signal sensor is a light sensor.

8. The holiday candy jar of claim 1 wherein said power supply is a battery.

9. The holiday candy jar of claim 1 wherein said sound producer is a speaker.

10. A holiday container with light and sound effects comprising a container with one opening, a signal sensor, a sound producer, a control circuit board, a plurality of color lights, a power supply, a means for mounting said signal sensor inside said container and near the opening of said container, a means for mounting said control circuit board, said sound producer, said color lights and said power supply inside said container.

11. The holiday container of claim 10 wherein said container is made of plastic.

12. The holiday container of claim 10 wherein said container is made of glass.

13. The holiday container of claim 10 wherein said container is made of earthenware.

14. The holiday container of claim 10 wherein said container looks like a pumpkin.

15. The holiday container of claim 10 wherein said container looks like an egg.

16. The holiday container of claim 10 wherein said signal sensor is a heat sensor.

17. The holiday container of claim 10 wherein said power supply is a battery.

18. The holiday container of claim 10 wherein said sound producer is a speaker.

* * * * *